US005931548A

United States Patent [19]

Bischoff

[11] Patent Number: 5,931,548

[45] Date of Patent: Aug. 3, 1999

[54] DRAWER INTERLOCK TO NON-INTERLOCK CONVERSION DEVICE

[75] Inventor: Daniel Ralph Bischoff, Grand Rapids, Mich.

[73] Assignee: SteelCase Inc., Grands Rapids, Mich.

[21] Appl. No.: 08/802,836

[22] Filed: Feb. 18, 1997

[51] Int. Cl.[6] ..... E05B 65/46

[52] U.S. Cl. ..... 312/221; 312/217

[58] Field of Search ..... 312/217, 221, 312/222

[56] References Cited

U.S. PATENT DOCUMENTS

| | | |
|---|---|---|
| 3,909,090 | 9/1975 | Breckner et al. . |
| 3,941,441 | 3/1976 | Scheerhorn . |
| 4,272,138 | 6/1981 | Stark . |
| 4,355,851 | 10/1982 | Slusser . |
| 4,425,013 | 1/1984 | Killen . |
| 4,441,767 | 4/1984 | Stark . |
| 4,447,098 | 5/1984 | Parker . |
| 4,637,667 | 1/1987 | Reid et al. . |
| 4,732,434 | 3/1988 | Hartrum . |
| 4,770,476 | 9/1988 | Lakso . |
| 4,820,002 | 4/1989 | Lechner et al. . |
| 4,854,653 | 8/1989 | Lakso . |
| 4,966,423 | 10/1990 | Higuera et al. . |
| 4,993,784 | 2/1991 | Dana et al. . |
| 5,050,942 | 9/1991 | Frederick et al. . |
| 5,184,887 | 2/1993 | O'Keefe et al. . |
| 5,303,994 | 4/1994 | Elsholz . |
| 5,335,986 | 8/1994 | Hartrum et al. . |
| 5,352,030 | 10/1994 | Derle et al. . |

*Primary Examiner*—Peter M. Cuomo
*Assistant Examiner*—Gerald A. Anderson
*Attorney, Agent, or Firm*—Price, Heneveld, Cooper, Dewitt & Litton

[57] ABSTRACT

A non-interlock blocking element adapted for use with a furniture unit having a plurality of drawers, a vertical guide for receiving a vertical stack of blocking elements which are slidably mountable in the guide for vertical translation therein, and a wedge element associated with each of the drawers which is reciprocable into the stack of blocking elements to effect interlocking relationships among the drawers is provided. The non-interlock blocking element allows such furniture units which are adapted for use with interlocking mechanisms, to be configured as non-interlocking furniture units, or as partially interlocking furniture units. The non-interlock blocking elements are generally similar to standard interlock blocking elements, but include a recess which allows unobstructed reciprocation of a wedge element associated with a drawer when the recess is in horizontal alignment with the wedge element, whereby the drawer can be opened irrespective of whether another drawer is already opened.

3 Claims, 13 Drawing Sheets

DRAWER INTERLOCK TO NON-INTERLOCK CONVERSION DEVICE

FIELD OF THE INVENTION

This invention relates to lockable furniture units of the type having two or more drawers, and in particular to furniture units adapted to incorporate an interlock system for preventing more than one drawer from being open at any given time.

BACKGROUND OF THE INVENTION

Furniture units with drawers are generally well known in the art, and typically include multi-drawer vertical files, such as those used in freestanding file cabinets, pedestals for desks, worksurfaces, computer support units, and other similar furniture applications. When the drawers in such furniture units are to be used for relatively heavy articles, such as document storage, the unit is preferably provided with some type of drawer interlock mechanism that will permit only one of the drawers to be opened at any given time, so as to avoid vertical instability, tipping, etc. Such interlock mechanisms are normally provided as a safety feature in freestanding vertical files.

Many people find the interlock system annoying and inconvenient at times, because it prevents more than one drawer from being opened at any given time, even when potential tipping hazards or vertical stability problems are non-existent. For example, a furniture unit, such as a desk pedestal, having a lower 12" file drawer and one or two upper 3" personal drawers, is not likely to tip if one of the upper 3" drawers is open when the file drawer is already open. The user of a furniture unit of this type may desire access to the contents of one of the 3" personal drawers while the file drawer is already opened, such as to get a pen to make a notation in the file before returning it to the file drawer. With a conventional interlock system, the file drawer must be closed before the personal drawer can be opened to obtain access to the contents thereof, and the personal drawer must be closed before the file drawer can be reopened. In many cases, it would be much more convenient to be able to simply open the personal drawer, such as to remove a pen, without having to first close the file drawer.

One way in which a furniture unit could be provided with a plurality of drawers which can be opened at the same time would be to simple eliminate the interlock mechanism. However, because the drawer interlock mechanism of conventional lockable furniture units generally cooperates with, and is integrated to, the interlock mechanism, it would be necessary to provide alternative locking means if it is desired to convert an existing furniture unit having lockable, interlocked drawers, into a furniture unit having lockable, non-interlocked drawers (i.e., drawers which can be opened irrespective of whether or not another drawer is already open). The use of alternative locking means would be particularly undesirable in situations where a manufacturer intends to manufacture both an interlocking version, and a non-interlocking version of a lockable furniture unit at the same manufacturing plant or production line, because excessive alternative manufacturing equipment, manufacturing processes, and inventory of parts would be required for the alternative locking means. Accordingly, it would be desirable to provide a means or device which is capable of converting a lockable furniture unit having an interlocking mechanism (for preventing a second drawer from being opened when a first drawer is already open) into a lockable furniture unit which allows a second drawer to be opened when a first drawer is already open, and which cooperatively interacts with an existing drawer locking mechanism, whereby the need for additional alternative locking means is eliminated.

Known furniture units with a plurality of drawers have either been of the interlocking type, wherein only one drawer can be opened at any given time, or of the non-interlocking type, wherein any or all of the drawers can be opened at any given time. Heretofore, partially interlocking drawer systems wherein at least one drawer can be selectively opened irrespective of whether other drawers are already opened, and wherein at least one other selected drawer cannot be opened if at least a third drawer is already opened, have not been sold or otherwise disclosed, nor have advantages thereof been described. However, a partially interlocking drawer system may be advantageous for certain types of drawer configurations, such as where it might be undesirable to have two or more large file drawers of a furniture unit opened at the same time, yet acceptable and desirable to have a small drawer opened at the same time that a file drawer is open. Accordingly, it would be desirable to provide a means or device for providing a furniture unit having selectable non-interlocking drawers and selectable interlocking drawers. Further, it would be desirable to provide such means or device which would allow such furniture unit to be reconfigured as interlocking, non-interlocking, or partially interlocking, as desired.

SUMMARY OF THE INVENTION

One aspect of the present invention is to provide a non-interlock blocking element for a furniture unit having a plurality of drawers and which includes a vertical guide adapted for receiving a plurality of blocking elements which interact with wedge elements associated with the drawers to prevent multiple drawers from being open at any given time, the non-interlock blocking element being slidably mountable in the vertical guide to configure the furniture unit so that at least one of the drawers is non-interlocking, i.e., capable of being opened irrespective of whether another drawer in the unit is already open. More specifically, the non-interlock blocking element is adapted for use with a furniture unit having at least an upper drawer and a lower drawer, a vertical guide for receiving a vertical stack of blocking elements which are slidably mountable in the guide for vertical translation therein, and first and second wedge elements associated with the upper and lower drawers respectively. The wedge elements are horizontally reciprocable into the stack of blocking elements when the associated drawer is opened to cause blocking elements disposed at an elevation above the wedge element reciprocated into the stack of blocking elements to be shifted upwardly, and the wedge element is also horizontally reciprocable completely out of the stack of blocking elements when the associated drawer is closed to allow the blocking elements disposed at an elevation above the wedge element reciprocated completely out of the stack of blocking elements to be shifted downwardly. The non-interlock blocking element includes a vertically elongate body having a recess adjacent an upper edge thereof for receiving a laterally adjacent reciprocable wedge element associated with an upper drawer when the upper drawer is open and when the non-interlock blocking element is shifted upwardly by a reciprocable wedge element associated with a lower drawer, whereby both upper and lower drawers can be open at the same time.

Another aspect of this invention is to provide a furniture unit including upper and lower drawers, a vertical guide, a plurality of blocking elements disposed directly on top of one another in a vertical stack and slidably mounted in the guide for vertical translation therein, and first and second wedge elements associated with the upper and lower drawer respectively. The wedge elements are horizontally reciprocable into the stack of blocking elements when the associated drawer is opened to cause the blocking elements disposed at an elevation above the wedge element reciprocated into the stack of blocking elements to be shifted upwardly, and the wedge elements are horizontally reciprocable completely out of the stack of blocking elements when the associated drawer is closed to allow the blocking elements disposed at an elevation above the wedge element reciprocated completely out of the stack of blocking elements to be shifted downwardly. The wedge element associated with the upper drawer is disposed along side of and in horizontal alignment with a bottom portion of a first one of the stacked blocking elements when the lower drawer is closed, and the wedge element associated with the upper drawer is disposed along side of and is horizontally aligned with an upper portion of a second one of the blocking elements disposed vertically adjacent to and below the first blocking element when the lower drawer is open. The second one of the blocking elements includes a recess at an upper portion thereof which allows unobstructed reciprocation of the wedge element associated with the upper drawer, whereby the upper drawer can be opened when the lower drawer is open.

A further aspect of the invention is to provide a furniture unit with an upper drawer and a plurality of vertically spaced apart lower drawers, in which at least one of the drawers is interlocked with another of the drawers, and at least one of the drawers is not interlocked with any of the other drawers. The furniture unit includes an upper drawer, a plurality of vertically spaced apart lower drawers, each lower drawer being vertically disposed below the upper drawer, a vertical guide, a plurality of blocking elements disposed directly on top of one another in a vertical stack and slidably mounted in the guide for vertical translation therein, and a wedge element associated with each of the drawers. Each wedge element is horizontally reciprocable into the stack of blocking elements when the associated drawer is opened to cause blocking elements disposed at an elevation above the wedge element reciprocated into the stack of blocking elements to be shifted upwardly, and the wedge elements are horizontally reciprocable completely out of the stack of blocking elements when the associated drawer is closed to allow blocking elements disposed at an elevation above the wedge element reciprocated completely out of the stack of blocking elements to be shifted downwardly. Each wedge element is disposed along side of and in horizontal alignment with a lower portion of one of the stack blocking elements when none of any lower wedge elements are reciprocated into the stack of blocking elements, and each wedge element is disposed along side of and in horizontal alignment with an upper portion of another blocking element when at least one of any lower wedge elements is reciprocated into the stack of blocking elements. At least a first one of the blocking elements includes a recess at an upper portion thereof which is disposed along side of and in horizontal alignment with a first one of the wedge elements when at least one of any lower wedge elements is reciprocated into the stack of blocking elements. The recess allows unobstructed reciprocation of the first wedge element when the first wedge element is in horizontal alignment with the upper portion of the first blocking element. At least a second one of the blocking elements includes an upper portion which is disposed along side of and in horizontal alignment with a second one of the wedge elements when at least one of any lower wedge elements is reciprocated into the stack of blocking elements. The upper portion of the second blocking element obstructs reciprocation of the second wedge element when the second wedge element is in horizontal alignment with the upper portion of the blocking element, thereby preventing the drawer associated with the second blocking element from being opened when any other interlocked drawer is open. Thus, the non-interlock blocking element of this invention, when used in combination with interlock blocking elements, allows a furniture unit having a plurality of drawers to be configured so that a certain drawer or drawers cannot be opened when another interlocked drawer is open, while at least one other non-interlocked drawer can be opened irrespective of whether another drawer or drawers are open.

In accordance with a further aspect of the invention, a method is provided for converting a furniture unit having interlocked drawers which cannot be open at the same time into a furniture unit having non-interlocked drawers which can be opened irrespective of whether another drawer or drawers are open. The method comprises providing a furniture unit with interlock drawers including a plurality of drawers, a vertical guide, a plurality of blocking elements disposed in a vertical stack and slidably mounted in the guide for vertical translation therein, and a wedge element associated with each of the drawers, the blocking elements obstructing reciprocation of any of the wedge elements into the stack of blocking elements when any of the other wedge elements has been reciprocated into the stack of blocking elements; removing at least one of the blocking elements having an upper portion which is in horizontal alignment with a wedge element associated with one of the drawers when a lower drawer is open; and replacing the removed blocking element with a blocking element having a recess at an upper portion thereof which allows unobstructed reciprocation of the wedge element associated with the selected drawer, whereby the selected drawer and another drawer can be open at the same time.

DETAIL DESCRIPTION OF THE PREFERRED EMBODIMENTS

Figure 1:
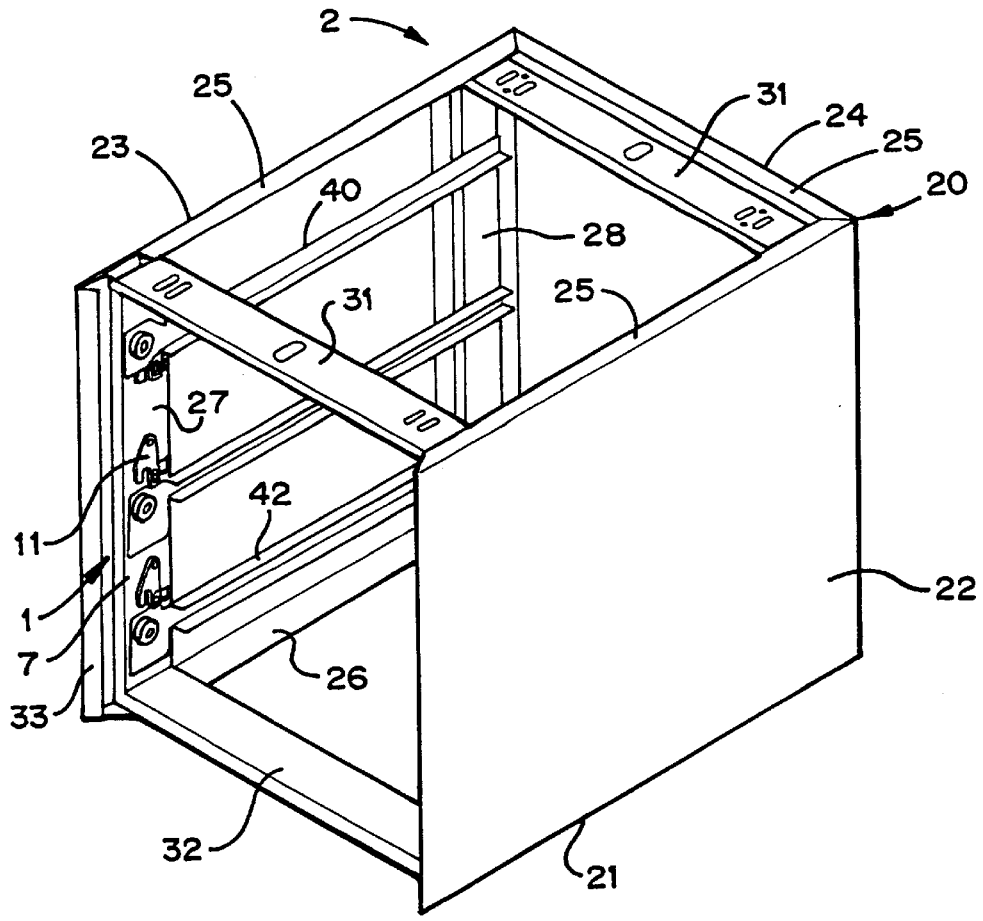
FIG. 1 is a perspective view of an interlock mechanism embodying the present invention, shown installed in a vertical file.
Figure 2:
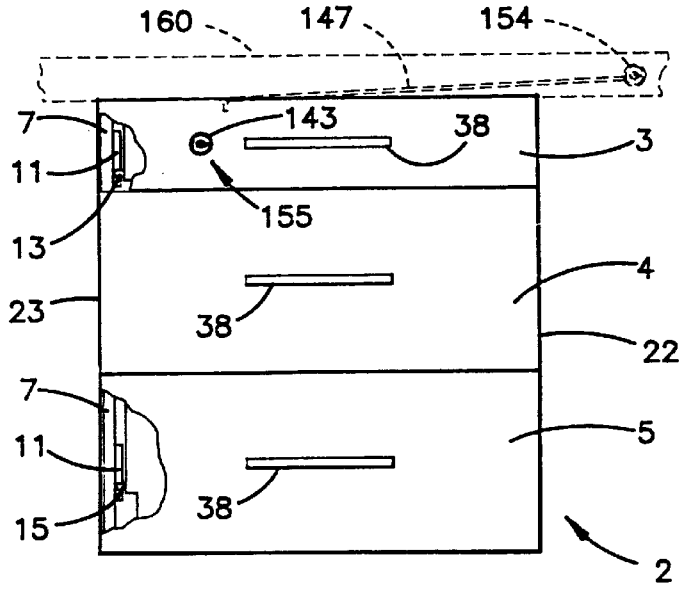
FIG. 2 is a front elevational view of the vertical file, with portions thereof broken away to reveal the interlock mechanism.
Figure 3:
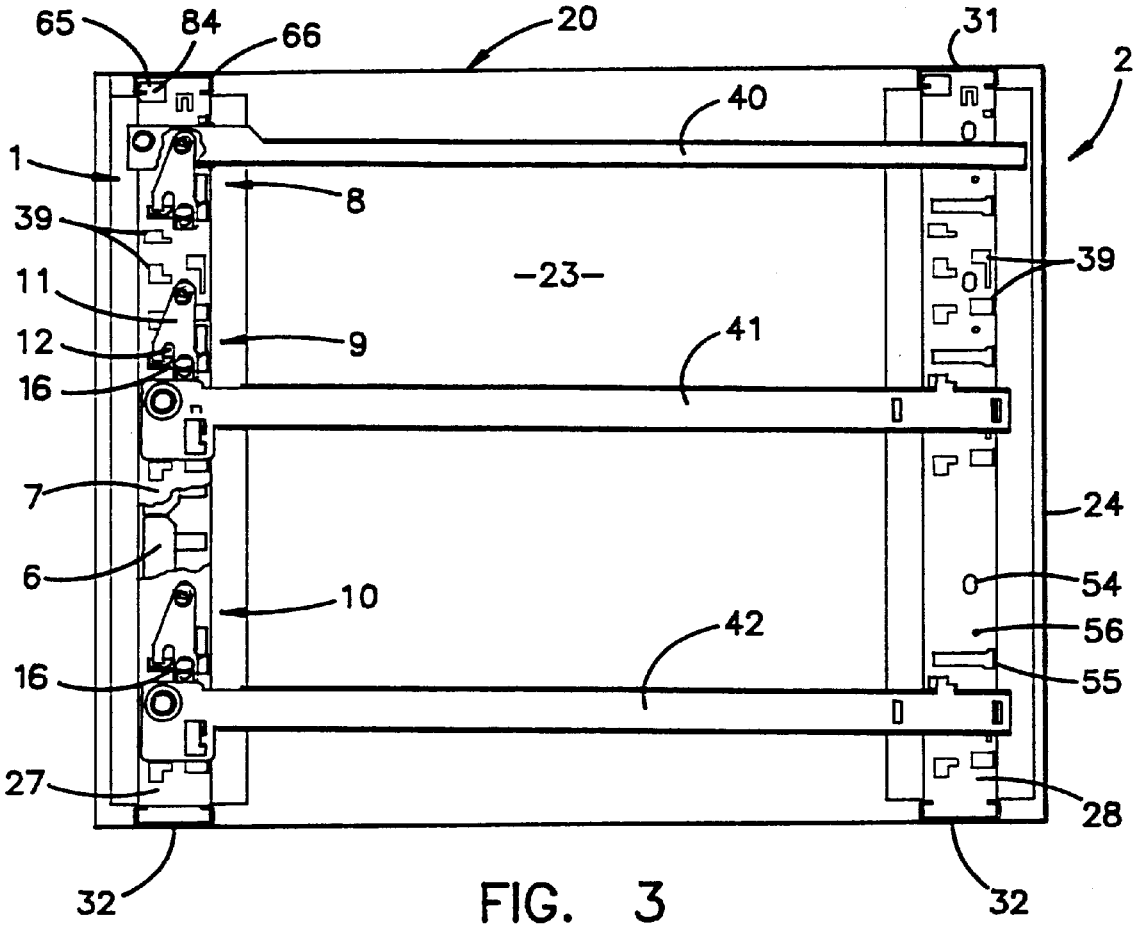
FIG. 3 is a vertical cross-sectional view of the vertical file cabinet.

For purposes of description herein, the terms "upper", "lower", "right", "left", "rear", "front", "vertical", "horizontal", and derivatives thereof shall relate to the invention as oriented in FIGS. 1–3. However, it is to be understood that the invention may assume various alternative orientations and step sequences, except where expressly specified to the contrary. It is also to be understood that the specific devices and process illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 10:
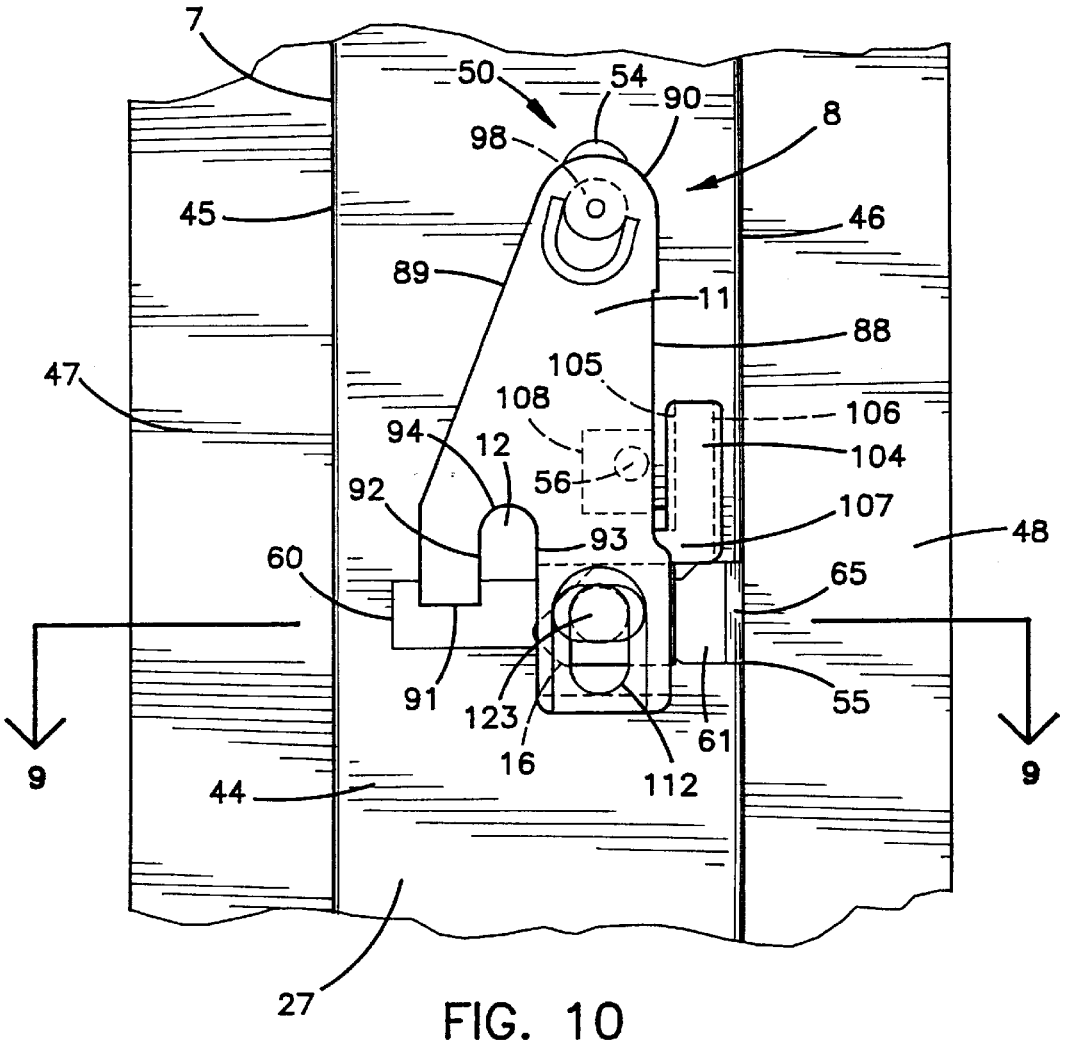
FIG. 10 is an enlarged, fragmentary, front elevational view of the actuator mounted on the guide, shown in an unlocked position when the drawer is closed.
Figure 12:
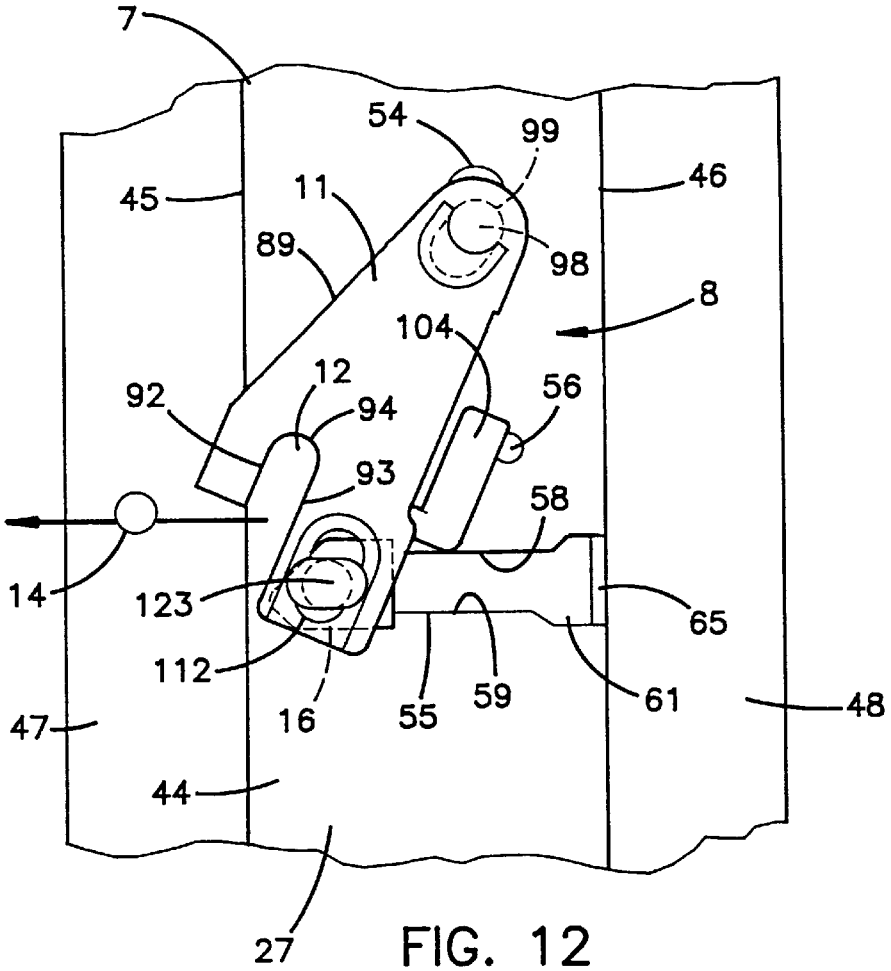
FIG. 12 is an enlarged, fragmentary, front elevational view of the actuator mounted on the guide, shown in a locked position when the drawer is open.

The reference numeral 1 (FIGS. 1–3), generally designates an interlock mechanism embodying the present invention. Interlock mechanism 1 is particularly adapted for use in conjunction with furniture units and the like of the type having two or more horizontally shifting drawers, such as the illustrated vertical file 2, having three, vertically arranged drawers 3–5. Interlock mechanism 1 functions to permit only one of the drawers 3–5 to be opened at any give time, so as to avoid vertical instability, tipping, etc. The illustrated interlock mechanism 1 includes a plurality of blocks 6 slidably mounted in a vertical guide 7, with three actuators 8–10 associated with drawers 3–5, respectively. Each of the actuators 8–10 comprises an arm 11 having an upper portion pivotally mounted to the guide 7, and a lower portion with a notch 12 shaped to selectively engage an associated one of three actuator pins 13–15 on drawers 3–5, such that the closing and opening of drawers 3–5 rotates the associated arm 11 between corresponding unlocked and locked positions, as shown in FIGS. 10 and 12, respectively. Each of the actuators 8–10 also includes a wedge 16 pivotally mounted on the lower portion of arm 11, and slidably supported on guide 7 to reciprocate inbetween adjacent blocks 6 when the associated one of the drawers 3–5 is opened, so as to lock closed all remaining drawers. Preferably, the vertical guide 7 is formed by a specially configured upright stiffener channel, and is positioned in the vertical file 2 in a manner, which maximizes the lateral space available for drawers 3–5.

The illustrated vertical file 2 (FIGS. 1–3) includes a case 20 in which drawers 3–5 are slidably mounted to reciprocate horizontally between fully opened and fully closed positions. Case 20 has an exterior skin 21 formed from a sheet metal blank or the like, comprising opposite side walls 22 and 23, and a rear wall 24, which are integrally interconnected in a fashion which imparts a rigid box-like configuration to case 20. Case walls 22–24 each include upper and lower flanges 25 and 26, which extend inwardly from the upper and lower edges thereof. Two pairs of substantially identical, specially configured, vertical stiffeners 27 and 28 are fixedly attached to the interior sides of sidewalls 22 and 23, opposite adjacent ends thereof, by means such as spot welding, adhesives, or the like. Two pairs of horizontal stiffeners 31 and 32 extend laterally across the upper and lower portions of case 20, and are connected to the upper and lower ends of oppositely facing vertical stiffeners 27 and 28, as well as to flanges 25 and 26, which together serve to rigidify case 20. The forward edges of sidewalls 22 and 23 are beveled inwardly to define associated front flanges 33, behind which forward portions of the front vertical stiffeners 27 are received in the manner described below.

Figure 17:
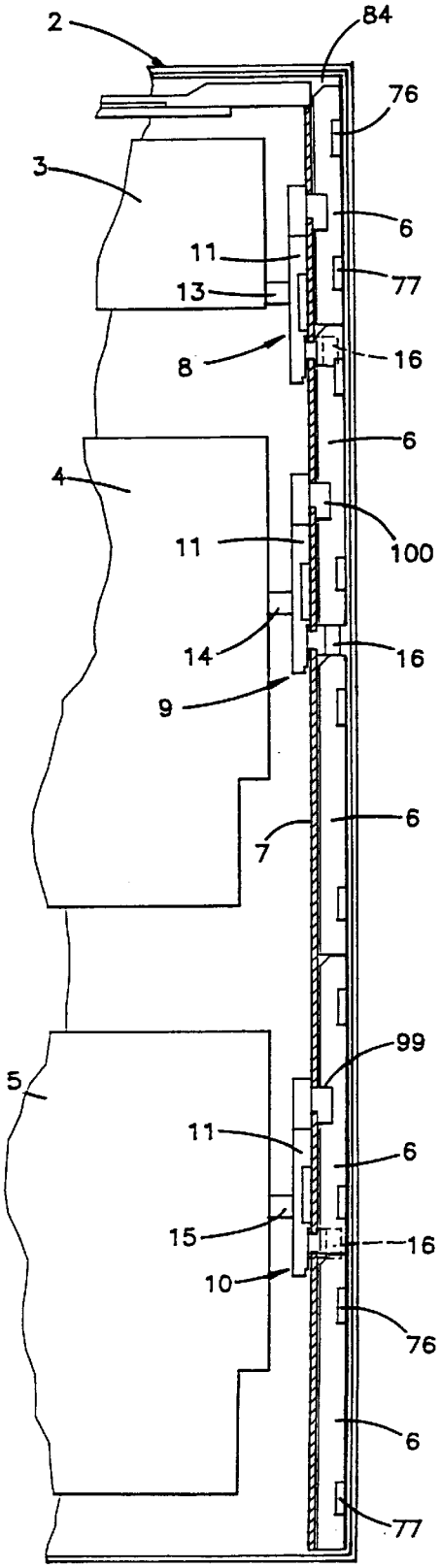
FIG. 17 is a partially schematic, front elevational view of the vertical file, shown with the center drawer closed.
Figure 18:
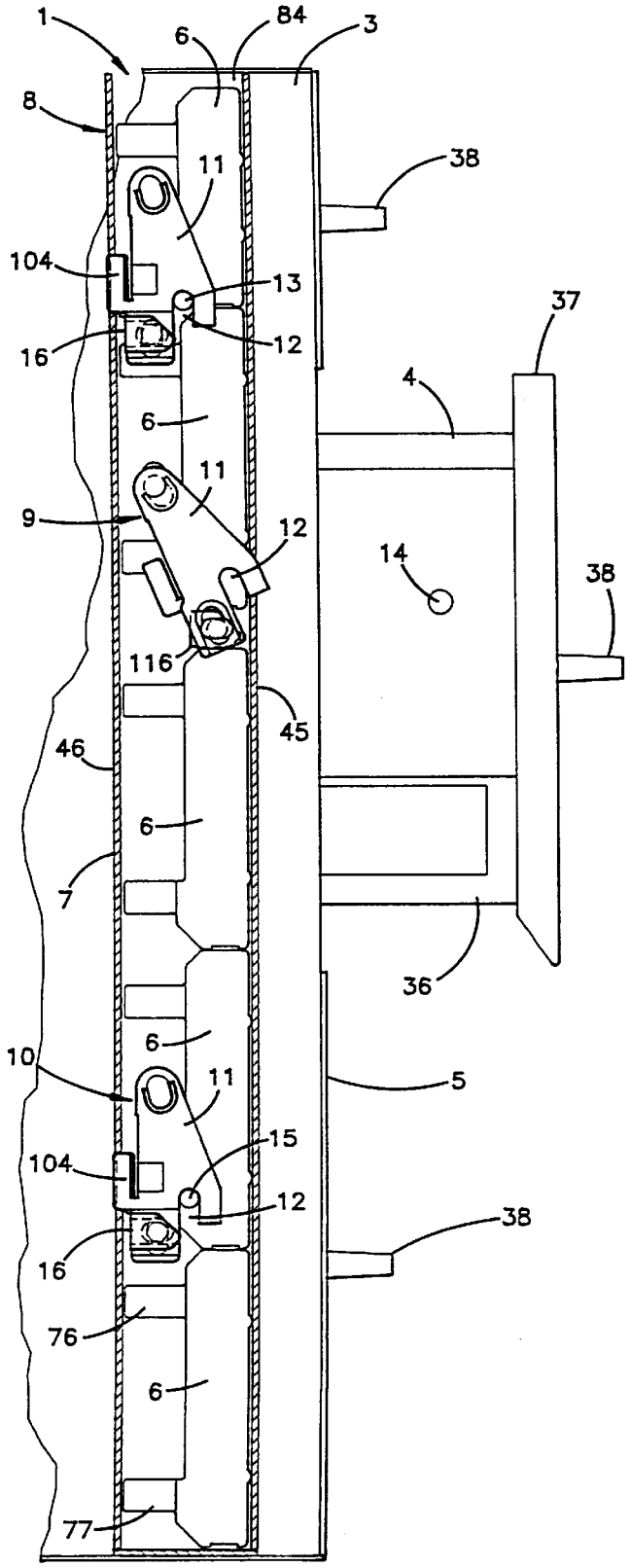
FIG. 18 is a partially schematic, side elevational view of the vertical file, shown with the center drawer opened.

Drawers 3–5 (FIGS. 2, 17 and 18) may have a conventional construction, comprising a rectangular, box-shape core assembly 36 (FIG. 18) on which a head 37 is mounted in the open forward end thereof, and includes a pull 38 to facilitate manually shifting drawers 3–5 between their fully closed and fully opened positions. Lock actuator pins 13–5 are located on the left-hand side of each of the associated drawers 3–5, adjacent the forward portion thereof, and protrude laterally outwardly therefrom to engage the notch 12 in the associated one of the actuators 8–10. In the illustrated example, drawers 3–5 each have a unique modular and convertible construction. However, it is to be understood that the present interlock mechanism 1 can also be used in conjunction with other types of drawer constructions.

The vertical stiffeners 27 and 28 (FIG. 3) include a series of slots 39 through the outer flanges thereof in which drawer suspension units 40–42 are detachably mounted to slidingly support associated drawers 3–5, respectively. In the illustrated example, drawer suspensions 40–42 have a generally conventional construction, and are located to position drawer actuators pin 13–15 in line with their respective actuators 8–10.

In the example shown in FIG. 1, the left-hand, front vertical stiffener 27 in case 20 defines guide 7, which as described in greater detail hereinafter, is specially configured to minimize the lateral space required for interlock mechanism 1, thereby maximizing the lateral space available for drawers 3–5 in such a manner that both 8½×11 and A4 sized drawers can be housed within the same case 20, without increasing the width of case 20 from its standard 8½×11 size. The illustrated guide 7 (FIGS. 4–7) comprises a rigid, elongate channel, having a generally U-shaped transverse cross-sectional configuration, including a central web 44 (FIG. 6), front and rear flanges 45 and 46 extending laterally along the opposite edges of web 44, and wing flanges 47 and 48 extending horizontally from front and rear flanges 45 and 46 in a fore-to-aft direction. As best illustrated in FIG. 6, wing flanges 47 and 48 are positioned adjacent to the interior surface of the left-hand sidewall 22 adjacent forward flange 33, and are fixedly attached thereto by means such as spot welding or the like. Guide channel 7 and sidewall 22 together define a vertically extending way or space 49 therebetween, having a rectangular transverse cross-sectional shape in which a vertical stack of blocks 6 are closely, yet slidably received.

Figure 6:
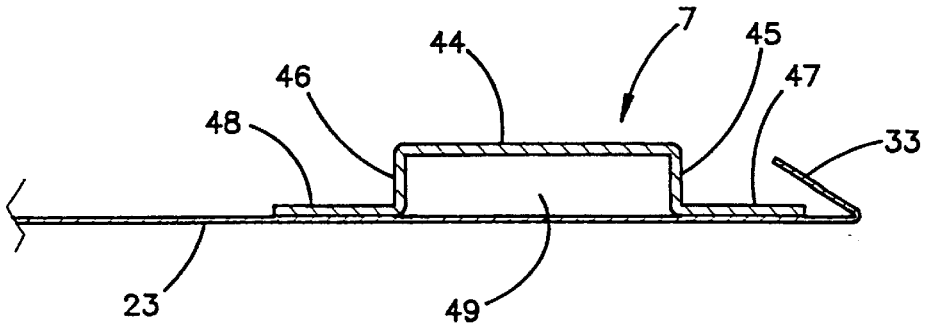
FIG. 6 is a horizontal cross-sectional view of the guide.
Figure 7:
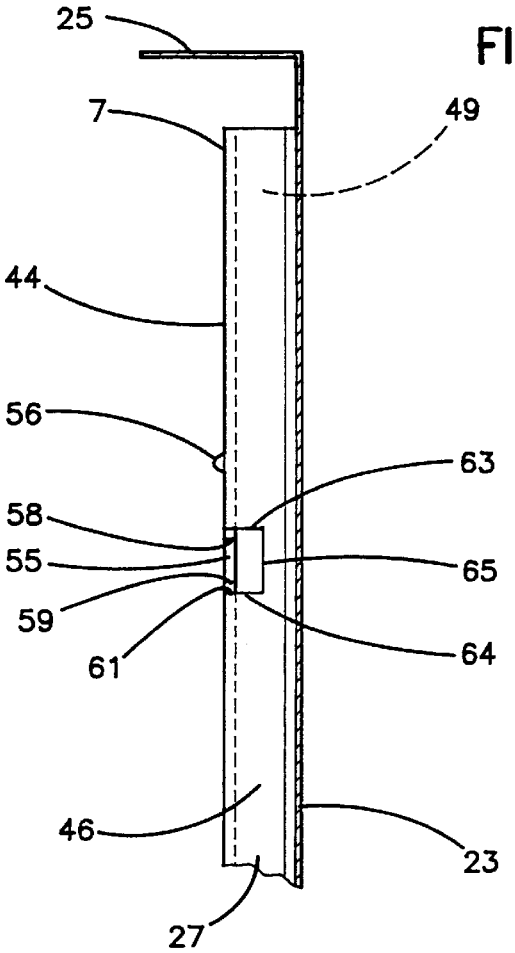
FIG. 7 is a fragmentary, rear end elevational view of the guide.
Figure 11:
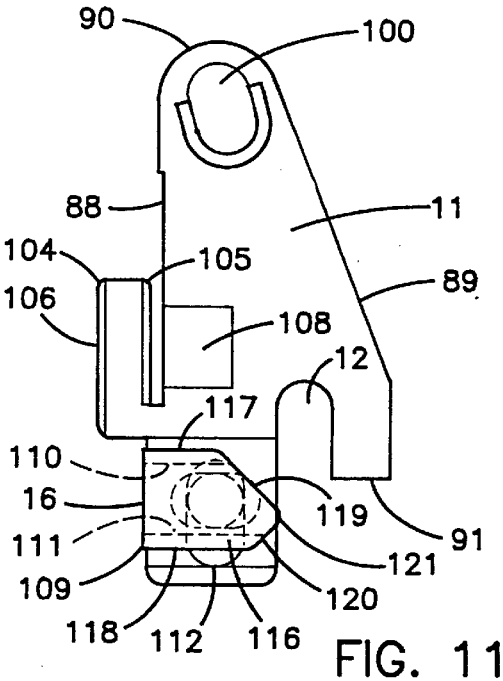
FIG. 11 is an enlarged, rear elevational view of the actuator.
Figure 8:
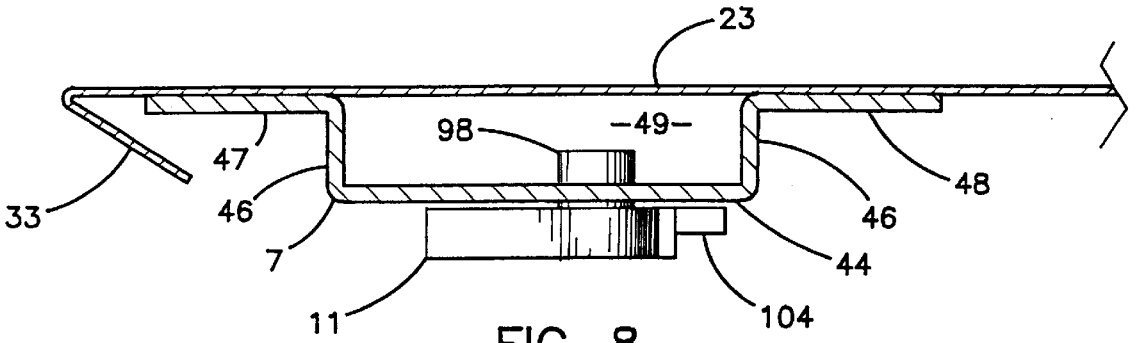
FIG. 8 is an enlarged, fragmentary top plan view of an actuator portion of the interlock mechanism mounted on the guide.
Figure 9:
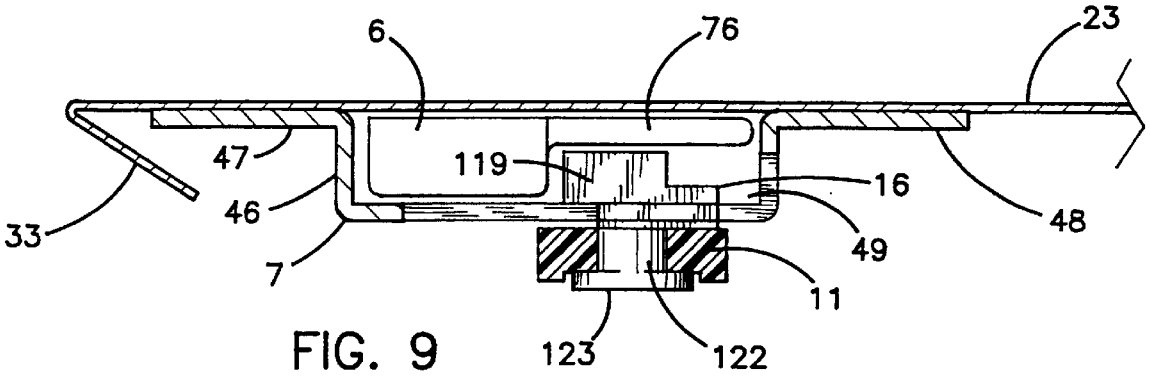
FIG. 9 is a horizontal, cross-sectional view of the actuator mounted on the guide, taken along the line IX—IX, FIG. 10.

Guide channel 7 (FIGS. 4–7) has a plurality of sets of openings which define separate actuator mounting stations 50 that are spaced regularly along the length of guide channel 7 in accordance with the incremental depth of drawers 3–5, such that interlock mechanism 1 can be readily configured and reconfigured to accommodate different depth drawers, as explained in greater detail hereinafter. With reference to FIG. 5, each actuator mounting station 50 includes a pin slot 54, a slide window 55, and a rounded protrusion 56, each of which is positioned at least in part in the web 44 of guide 7. Pin slot 54 is vertically elongated, and includes semi-circular end edges 57. Pin slot 54 extends through web 44, and is positioned with its major axis located slightly rearwardly from the center line of web 44. Slide window 55 is generally key-shaped, and is positioned vertically below its associated pin slot 54. The illustrated slide window 55 is defined by generally parallel upper and lower edges 58 and 59, and a forward end edge 60. End edge 60 is positioned slightly rearwardly from the front flange 45 of guide channel 7, while upper and lower edges 58 and 59 merge into an enlarged guide portion 61 of slide window 55, which extends laterally outwardly into the rear flange 46 of guide 7, as defined by associated edges 63–64 (FIG. 7). As described in greater detail hereinafter, the guide portion 61 of slide window 55 is shaped to laterally receive an associated wedge 16 therein. Rounded protrusion 56 extends laterally outwardly from the exterior side of web 44, has a generally semi-spherical shape, and is positioned horizontally on web 44 slightly rearwardly from the center line of pin slot 54. In the illustrated example, actuator mounting stations 50 are located approximately six inches apart along the length of guide 7.

Guide channel 7 has upper and lower ends 66 and 67 received within horizontal stiffeners 31 and 32 and extends continuously therebetween. The upper end 66 (FIGS. 3–5) of guide channel 7 includes a rectangularly-shaped window 65 through web portion 44 into which a sliding lock actuator 130 (FIGS. 14–16) is received in the manner described in greater detail hereinafter.

The illustrated blocks 6 (FIG. 4) have an incremental length corresponding to the incremental depth of drawers 3–5, which in one working embodiment of the present invention is approximately three inches. Each block 6 has an irregular hexagonal side elevational shape, comprising a front edge 70, top and bottom edges 71 and 72, inclined ramp edges 73 and 74, and a rear edge 75. A pair of fingers 76 and 77 extend rearwardly from rear edge 75, and serve to expand the effective width of block 6, so as to be closely, yet slidably received within guide 7. The provision of fingers 76 and 77 permits the mounting of drawer suspension units 40–42 in the slots 39 in web 44 of guide 7, without interfering with the vertical sliding motion of blocks 6.

Figure 4:
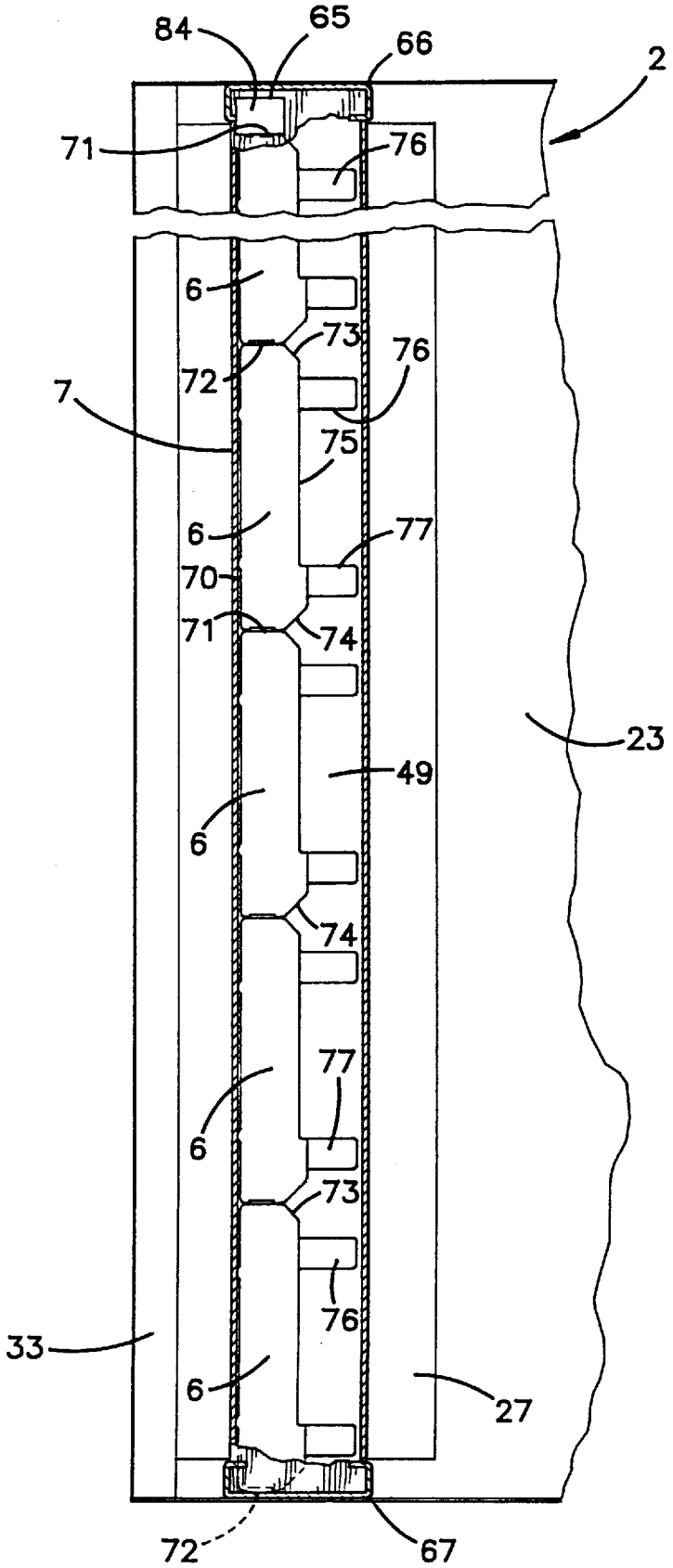
FIG. 4 is a fragmentary, vertical cross-sectional view of the vertical file, with portions thereof broken away to show vertically stacked blocks slidably supported in a mating guide.
Figure 5:
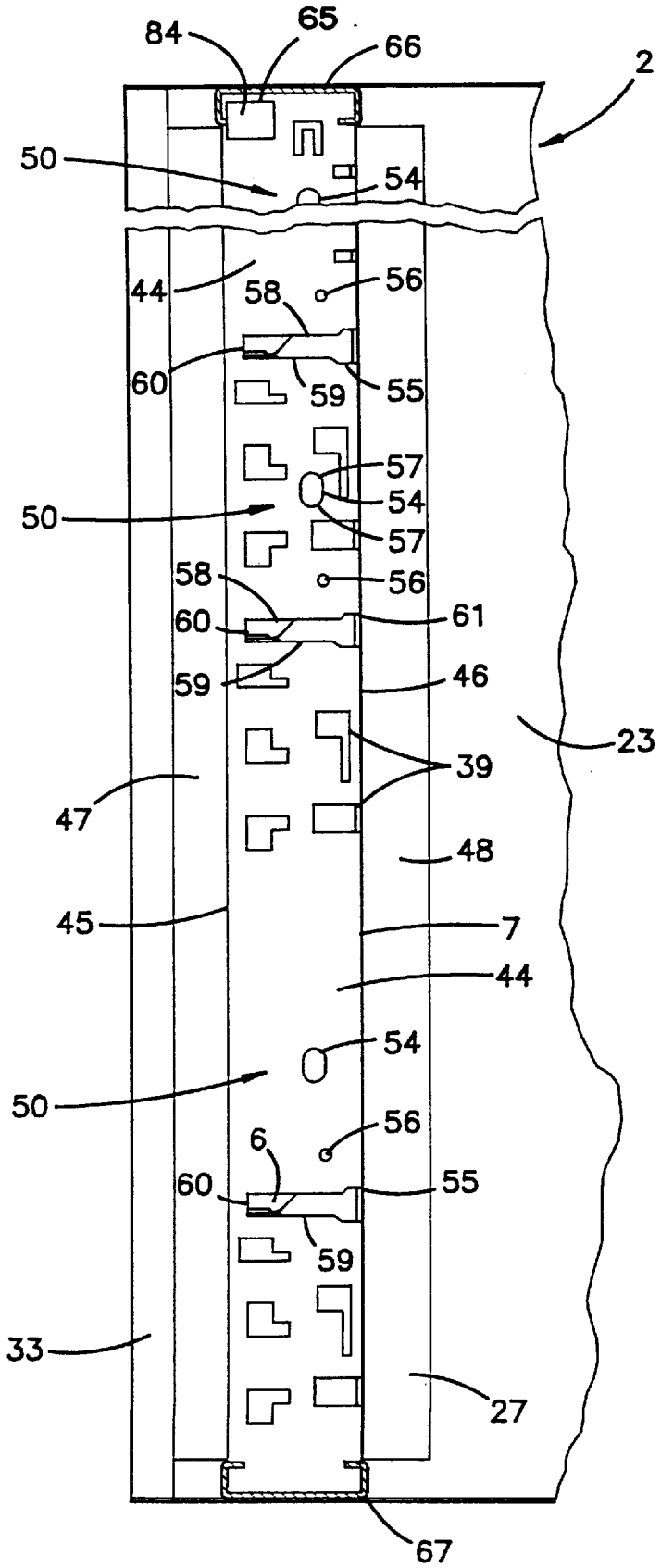
FIG. 5 is a fragmentary, side, elevational view of the guide.

As best illustrated in FIGS. 4 and 5, blocks 6 are arranged in a vertically, stacked arrangement, retained within the interior way 49 of guide 7. Blocks 6 and guide 7 are mutually sized so that when the bottom edge 72 of the lowermost block 6 is flush with the lower end 67 edge of guide 7, the top edge 71 of the uppermost block 6 is spaced apart from the upper end 66 of guide channel 7 to define a locking space 84 therebetween for purposes to be described in greater detail hereinafter.

With reference to FIGS. 8–13, interlock actuators 8–10 have a substantially identical construction, and can be located in any one of the actuator mounting stations 50. Hence, for ease of description herein, reference shall be had only to actuator 8, it being understood that all other actuators, including actuators 9 and 10 are substantially identical. The arm portion 11 of actuator 8 is in the nature of a cam, having a generally triangular side elevational configuration defined by a rear edge 88, a front edge 89, a rounded upper edge 90, and a notched lower edge 91. The notch 12 in actuator 8 extends in a generally parallel fashion with rear edge 88, and is defined by parallel side edges 92 and 93, and arcuate end edge 94.

A mounting pin 98 protrudes from the rear surface of actuator cam 11, and is shaped to be received within an associated one of the pin slots 54 in guide 7. The illustrated mounting pin 98 includes a generally cylindrically shaped shank 99 having a diameter slightly smaller than the width of pin slot 54, and an enlarged oblong head 100, which is shaped slightly smaller than the plan configuration of pin slot 54, so as to be closely received therein. The central axis of head 100, is positioned eccentrically with respect to the central axis of shank 99, such that when mounting pin 98 is inserted into an associated pin slot 54, the cam 11 is shifted downwardly within pin slot 54, and the outwardly protruding head 100 on mounting pin 98 extends over the interior side of guide web 44 to detachably lock cam 11 on guide 7 in a manner which permits cam 7 to smoothly pivot about shank 99 in a fore-to-aft direction.

Cam 11 (FIGS. 8–13) also includes a resilient positioner element in the form of a wing 104, which projects rearwardly from the rear edge 88 thereof. Wing 104 has a generally rectangular plan configuration, with its longitudinal axis oriented generally vertically, and includes beveled leading and trailing edges 105 and 106, respectively. Wing 104 has a relatively narrow neck 107 which connects the same with the rear edge 88 of cam 11, and is preferably integrally formed with cam 11 from a resilient material, such as plastic or the like, such that wing 104 is resiliently, laterally flexible with respect to cam 11, in the nature of a leaf spring or the like. Cam wing 104 is positioned to abuttingly engage an associated one of the rounded protrusions 56 on guide 7 in a manner which serves to retain the cam 11 in its set locked and unlocked positions, as described in greater detail hereinafter. A depression or recess 108 is provided on the rear surface of cam 11, and is shaped to receive rounded protrusion 56 therein when cam 11 is in the unlocked position, as illustrated in FIG. 10.

The lower portion of cam 11 (FIGS. 8–13) includes a longitudinally elongated aperture 112 therethrough in which an associated wedge 16 is rotatably mounted. The illustrated wedge 16 has a primary body portion 109 with upper and lower grooves 110 and 111 formed therein into which the upper and lower edges 58 and 59 of an associated slide window 55 are closely received to slidably mount wedge 16 for horizontal reciprocation therein. A block separator 116 extends rearwardly from the body portion 109 of wedge 16, and includes upper and lower edges 117 and 118, and angled forward edges 119 and 120, arranged in a dihedral configuration intersecting along a parting edge 121. The angled forward edges 119 and 120 of block separator 116 are shaped similar to the ramp edges 73 and 74 of blocks 6 for sliding engagement therebetween. A mounting pin 122 extends forwardly from block separator 116, and includes an enlarged head 123 sized to be closely received through the aperture 112 in cam 11 with a snap lock type of action. When block separator 116 is oriented in its horizontal operational position, the head 123 of mounting pin 122 is pivoted ninety degrees from its insertion position, so as to positively, yet pivotally interconnect block separator 116 with cam 11, without requiring any separate fasteners.

In operation, an actuator 8 is installed in each of the actuator mounting stations 50 associated with an associated drawer. In the illustrated example, actuators 8–10 are mounted adjacent drawers 3–5 respectively. Each actuator is installed in its associated mounting station 50 in the following manner. The block separator 116 (FIGS. 8–13) is connected with the lower portion of cam 11 by inserting mounting pin 122 through aperture 112, and rotating block separator 116 ninety degrees in the fashion described hereinabove. Block separator 116 is then inserted into the enlarged guide portion 61 of slide window 55, between window edges 63–65. The grooves 110 and 111 on wedge body 109 are aligned with the upper and lower edges 58 and 59 of slide window 55, and wedge 16 is shifted forwardly to achieve sliding engagement therebetween, such that block separator 116 is captured within slide window 55, and can slidingly reciprocate in a horizontal direction freely therein.

Next, the mounting pin 98 at the upper portion of cam 11 is mounted in pin slot 54, by inserting head 100 therethrough, and shifting cam 11 slightly downwardly, so that the shank portion 99 of mounting pin 98 rests against the lower edge 57 of pin slot 54, as illustrated in FIG. 10. Both of the remaining actuators 9 and 10 are similarly mounted in their associated actuator mounting station 50 to correspond with center drawer 4 and bottom drawer 5, respectively.

When one of the drawers 3–5 is opened, the block separator 116 on the associated one of the actuators 8–10 is inserted into the vertical string of block 6. When all of the blocking elements are of the type shown in FIG. 4, wherein the upper portion of the blocking element 6 is configured to obstruct reciprocation of the wedge elements 16 when the blocks are shifted upwardly so that the wedge element is in alignment with the upper portion of a blocking element 6, then the remaining drawers are locked closed. For example, when the center drawer 4 is open, as shown schematically in FIGS. 17 and 18, actuator pin 14 moves horizontally forwardly, thereby rotating the cam 11 of actuator 9 forwardly. The rotation of cam 11 causes block separator 116 to slide forwardly within slide window 55, such that the angled forward edges 119 and 120 of block separator 116 engage the adjacent ramp edges 73 and 74 of vertically adjacent block 6 to thereby vertically separate the same, and insert block separator 116 squarely inbetween the bottom edge 71 of the upper block 6, and the upper edge 72 of the lower block 6. In this locked position, the block separator 116 positively prevents vertical movement of each of the blocks 6 positioned below the block separator 116. Furthermore, the block 6 positioned above block separator 116 are shifted vertically so that their ramp surfaces 73 and 74 are out of horizontal alignment with separator blocks 116, such that the block separator 116 on the uppermost actuator 8 will engage the rear edge 75 of the associated block 6 in the event someone attempts to open top drawer 3. Hence, the insertion of block separator 116 into the vertical string of block 6 effectively locks closed all of the other drawers.

When center drawer 4 (FIGS. 4 and 5) is closed, actuator pin 14 engages the rearward edge 93 of notch 12, thereby pivoting the cam 11 of actuator 9 rearwardly to withdraw the block separator 116 from the vertical string of blocks 6, thereby permitting another one of the drawers to be opened.

Figure 13:
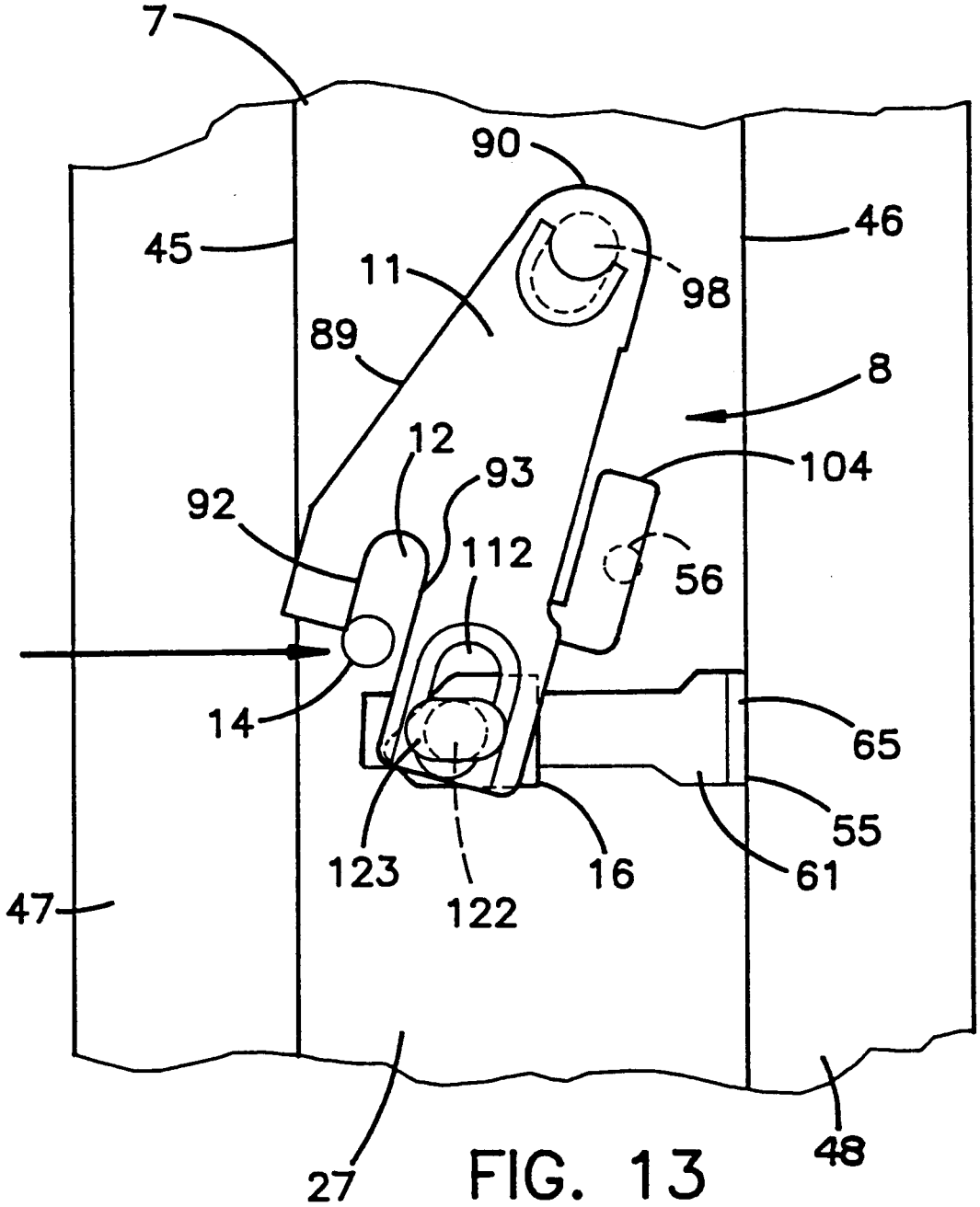
FIG. 13 is an enlarged, fragmentary, front elevational view of the actuator mounted on the guide, shown being shifted toward the unlocked position when the drawer is nearly fully closed.

As best illustrated in FIGS. 8–13 selective resilient engagement between cam wing 104 and rounded protrusion 56 serves to help ensure that cam 11 will not be inadvertently moved from is set locked and unlocked positions. When cam 11 is in the unlocked position, as shown in FIG. 10, rounded protrusion 56 is located within the recess 108 on the rear side of cam 11, such that there is no engagement therebetween, and cam 11 can pivot forwardly freely. As cam 11 is rotated forwardly, when the associated drawer is opened, the leading edge 105 of cam wing 104 engages rounded protrusion 56, and establishes resilient contact therebetween. When cam 11 is shifted to is fully locked position, as shown in FIG. 12, the trailing edge 106 of cam wing 104 passes over rounded protrusion 56 with a slight snapping type of action, and abuts the same, so as to prevent inadvertent movement of cam 11 back to the unlocked position. When the associated drawer is returned to its closed position, cam wing 104 again passes over rounded protrusion 56, as shown in FIG. 13. The contact between cam wing 104 and rounded protrusion 56, in conjunction with the geometry of actuator 8 causes arm 11 to shift upwardly, with mounting pin raising in pin slot 54. When the drawer is fully closed, cam wing 104 snaps over rounded protrusion 56, and cam 11 drops back down into its normal position, with shank 99 resting against the lower end edge 57 of pin slot 54, so as to assume the position illustrated in FIG. 10. This selected contact between cam wing 104 and rounded protrusion 56, and vertical shifting motion of cam 11, combine to help prevent cam 11 from pivoting inadvertently from either its locked or unlocked positions.

Figure 15:
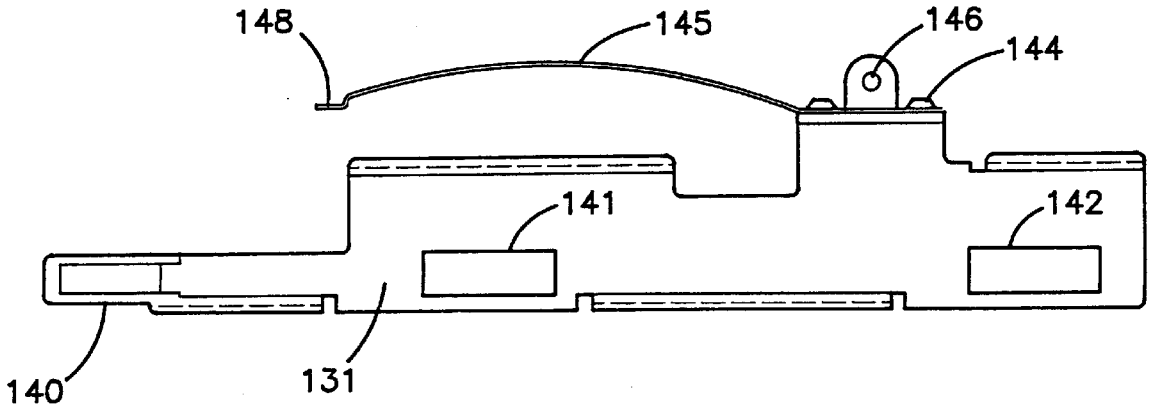
FIG. 15 is a top plan view of the lock actuator.
Figure 14:
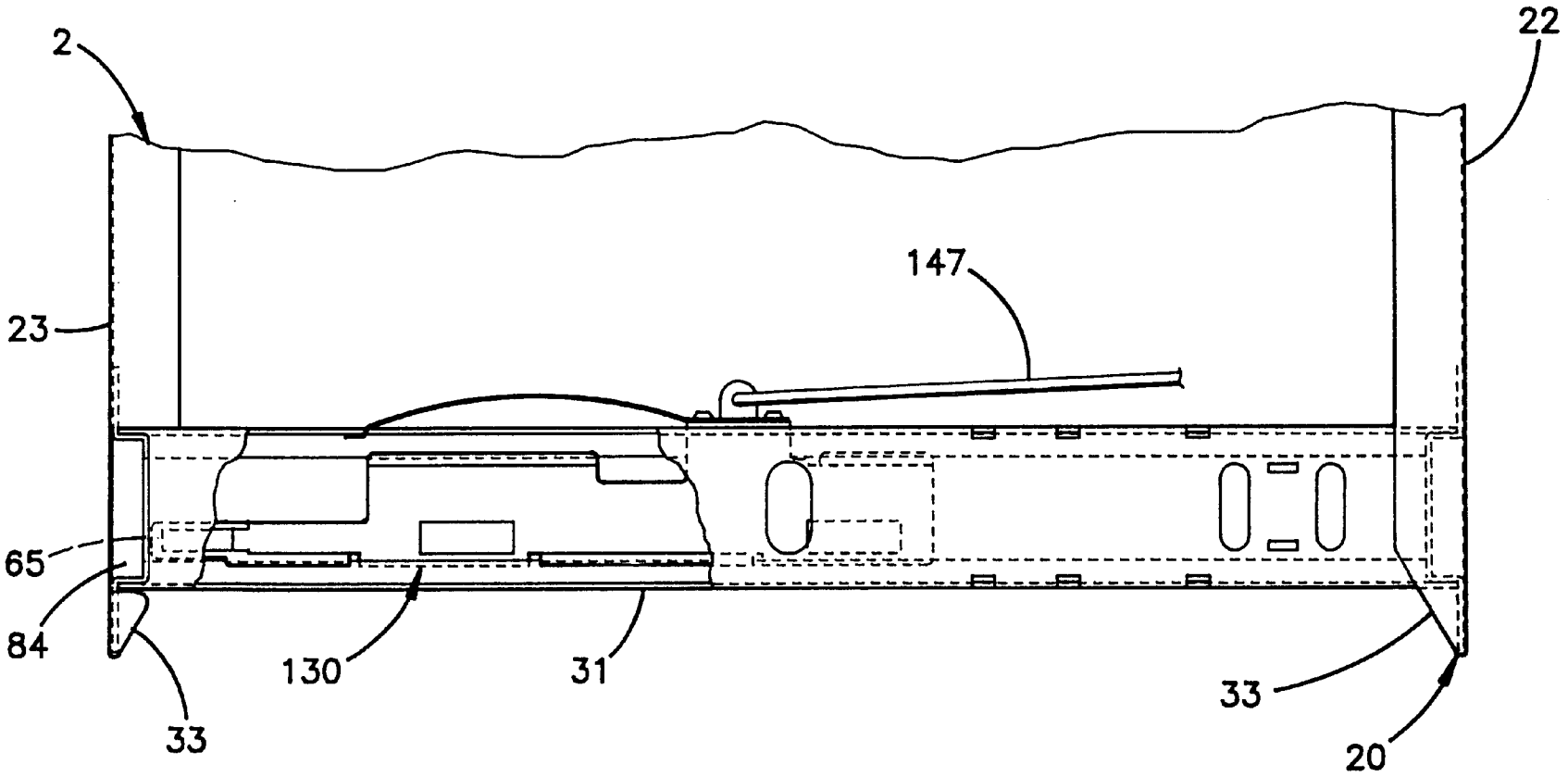
FIG. 14 is a fragmentary, top plan view of the vertical file, particularly showing a lock actuator.
Figure 16:
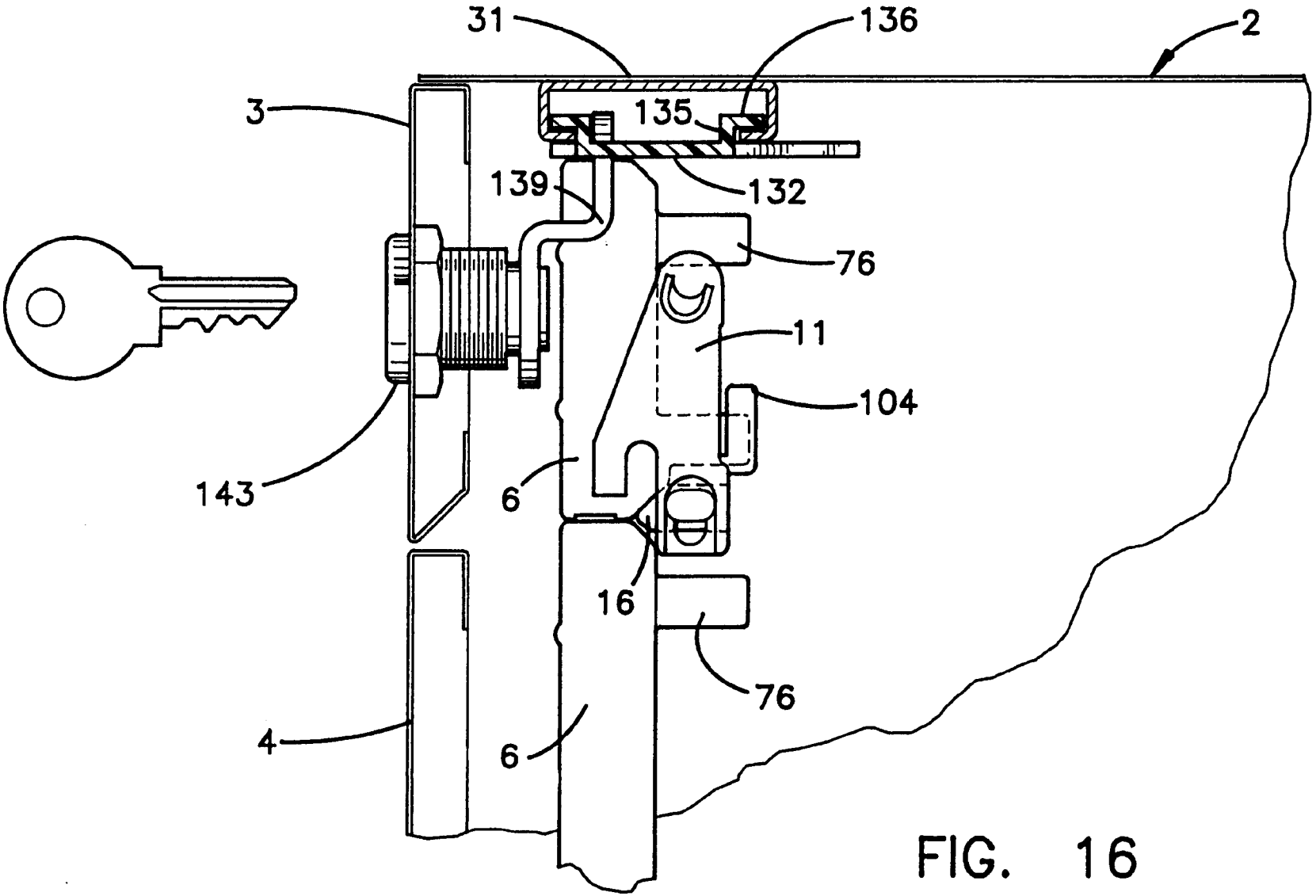
FIG. 16 is a fragmentary, vertical cross-sectional view of an upper portion of the vertical file, showing the lock actuator.

With reference to FIGS. 14–16, a lock actuator 130 is illustrated, which is particularly adapted for use in conjunction with interlock mechanism 1. Lock actuator 130 functions to simultaneously lock all drawers 3–5 in their fully closed position for security.

The illustrated lock actuator 130 comprises a slide 131 that is slidably supported in the forward, upper, horizontal case stiffener 31 for generally horizontal motion therein. Slide 131 has a generally U-shape transverse, cross-sectional shape, comprising a central web 132, with a pair of upstanding L-shaped sides, comprising flanges 135 and 136 shaped to snap within the interior of channel-shaped case stiffener 31. Slide 131 includes a finger 140 extending longitudinally from an outside end thereof, which is shaped to be closely received through the mating window 65 in guide 7, so as to substantially fill locking space 84. When finger 140 is inserted into locking space 84, engagement between the uppermost block 6 and slide finger 140 prevents any of the blocks 6 from being separated from one another a distant sufficient to permit a block separator 116 from being inserted between vertically adjacent blocks 6, so as to positively lock each of the drawers 3–5 in their fully closed position. Slide 131 includes two vertically oriented actuator windows 141 and 142 spaced longitudinally apart therein, which are shaped to receive therein an associated strike plate portion 139 (FIG. 16) of a key lock 143, as described in greater detail hereinafter. Slide 131 also includes a bracket portion 144 disposed along the rear edge of slide 141, and has one end of a leaf spring 145 attached thereto. Bracket 144 includes vertically extending control rod aperture 146 therein into which a control rod 147 from a center lock system (FIG. 1) can be inserted. The free end 148 of leaf spring 145 is formed to be closely received and detachably retained within an associated slot 149 in the rear flange of horizontal stiffener 31, as shown at FIG. 14. Leaf spring 145 is configured to resiliently urge slide 131 toward its normal unlocked position.

Lock actuator 130 is designed to be used in conjunction with either a center lock arrangement 154, as shown by the broken lines in FIG. 2, or in a drawer front configuration 155, as shown by the solid lines in FIG. 2. When a drawer front configuration 155 is desired, key lock 143 is mounted in the head 37 of top drawer 3, such that associated strike arm 139 (FIG. 16) is received within one of the actuator windows 141 and 142 of slide 131, depending upon whether the lock is positioned in either a center or left side location on the drawer front. Rotation of the tumbler portion of key lock 143 rotates strike arm 139, thereby shifting slide 131 laterally to selectively position finger 140 within the locking space 84 of guide 7 to lock all drawers 3–5 closed.

In the event a center lock arrangement 154 is desired, the actuator rod 147 associated with the center key lock is inserted into aperture 146 of bracket 144, which serves to selectively shift slide 131 laterally between the locked and unlocked positions.

The illustrated vertical file 2 is extremely versatile, and can be used in many different environments. For example, vertical file 2 can be used either as a freestanding filing unit, or as a pedestal for a worksurface 160, as shown by the broken lines in FIG. 2. The compact construction of case 20, vertical stiffeners 27 and 28, and incorporation of interlock mechanism 1 therein, permits a standard sized case to accept either 8½×11 or A4 size file drawers therein. Interlock mechanism 1 can be snap locked into case 20 at several different locations to accommodate various drawer configurations. The lock mechanism 130 can be easily snapped into place, or removed completely as desired, and can accommodate either a center lock configuration 154, or a drawer front configuration 155.

Drawer interlock 1 is extremely reliable, and is also flexible to readily adapt the same for use in conjunction with many different drawer configurations. The cam 11 and sliding block separator 116 of interlock mechanism 1 positively prevent more than one drawer from being opened at a time. The snap positioning feature achieved by engagement between cam wing 104 and rounded protrusion 56, as well as the vertical shifting motion of cam 11, assists in retaining each cam 11 in its set locked and unlocked positions, and thereby helps to prevent inadvertent movement therefrom. By positioning blocks 6 in a specially designed vertical stiffener 27, the available lateral space within case 20 is maximized for greater storage capacity.

Having thoroughly described the known furniture units and interlock mechanisms in which the non-interlock blocking elements of this invention may be utilized, the non-interlock blocking elements and furniture units incorporating the non-interlock blocking elements will now be described.

Figure 19:
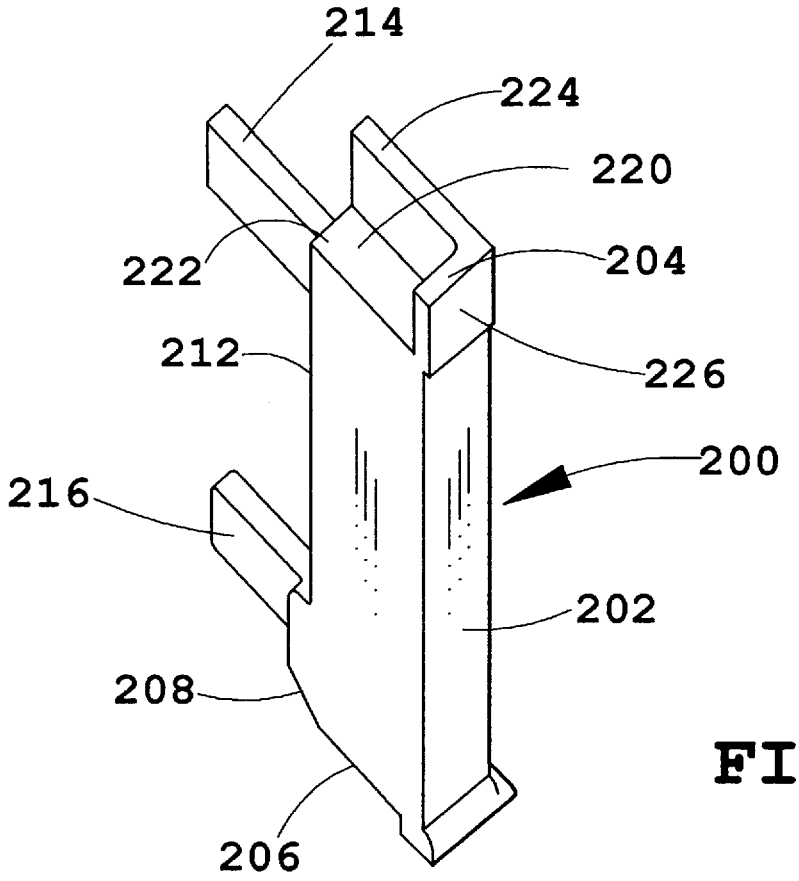
FIG. 19 is a front perspective view of a non-interlock block in accordance with the invention.
Figure 20:
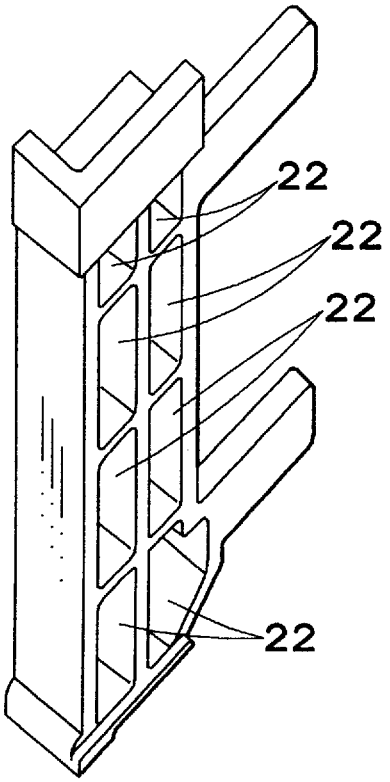
FIG. 20 is a rear perspective view of the non-interlock block shown in FIG. 19.

In FIGS. 19 and 20, there is shown a non-interlock blocking element 200 in accordance with this invention. The non-interlock blocking element 200 is generally similar in size and shape to the interlock blocking element 6 previously described. As with block element 6, non-interlock blocking elements 200 has an irregular polygonal side elevational shape, comprising a front edge 202, top and bottom edges 204 and 206, an inclined ramp edge 208, and a rear edge 212. A pair of fingers 214 and 216 extend rearwardly from rear edge 212, and serve to expand the effective width of block 200, so as to be closely, yet slidably received within guide 7. The provision of fingers 214 and 216 permits the mounting of drawer suspension units 40–42 in the slots 39 in web 44 of guide 7, without interfering with the vertical sliding motion of block 6. The fundamental difference between the non-interlock blocking elements 200 and the interlock blocking elements 2006, is that the non-interlock blocking elements each include a recess 220 at an upper portion thereof which allows unobstructed reciprocation of wedge elements 16 when a wedge element 16 is in horizontal alignment with the upper portion of a non-interlock blocking element 200, whereas the interlock blocking elements 6 do not include a recess, but instead are solid, i.e., configured to obstruct reciprocation of the wedge elements 16 when the upper portion of an interlock blocking element 6 is in horizontal alignment with a reciprocating wedge element 16. Recess 220 may be described as a cut-out defined by an upwardly facing horizontal wall 222 and a pair of connected upright walls 224 and 226 which are arranged in an L-shape. However, it is to be understood that the cut-out or recess 220 could be defined by any generally upwardly facing surface 222 and any wall which projects upwardly therefrom to engage the bottom edge of an adjacent blocking element 6 or 200. For example, wall 226, or wall 224, or any portion or combination thereof, could be used to provide the necessary spacing between adjacent lower and upper blocking elements, and the necessary clearance to allow unobstructed reciprocation of a wedge element 16 when the upper portion (i.e., recess 220) of a non-interlock blocking element is in alignment with the wedge element. However, the combination of connected walls 224 and 226 arranged in an L-shape has been found to eliminate any tendency of non-interlock blocking elements to become misaligned or jammed.

Figure 21:
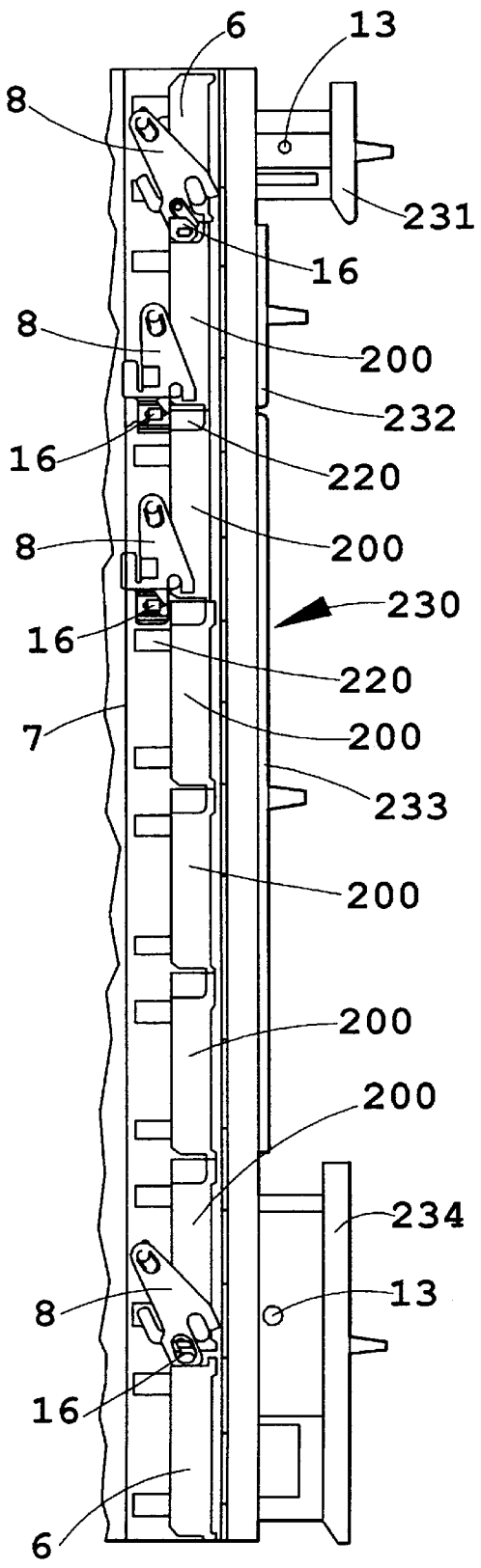
FIG. 21 is a partially schematic, side elevational view of a vertical file including a plurality of non-interlock blocking elements which allow any or all of the drawers to be open at the same time.

In FIG. 21, there is illustrated a furniture unit 230 having a plurality of drawers 231, 232, 233 and 234. Each drawer includes an associated actuator having a wedge element 16. A plurality of non-interlock blocking elements 200 and conventional blocking elements 6 are arranged in a vertical stack within a vertical guide 7 to provide a non-interlocked drawer system wherein any or all of the drawers may be open at the same time. In FIG. 21, bottom drawer 234 has been opened causing the wedge element 16 associated with the bottom drawer to engage the ramp edge 208 of the non-interlock blocking element 200 positioned immediately above the lowermost conventional blocking element 6, and reciprocate into the stack, thereby vertically separating the two lowest blocking elements 6 and 200. Separation of the lowermost blocking elements 6 and 200 causes all of the blocking elements disposed above the lowermost blocking element 6 to be shifted upwardly so that the remaining wedge element 16 associated with drawers 231, 232 and 233 are in horizontal alignment with recesses 220 in non-interlock blocking elements 200, thus allowing unobstructed reciprocation of the wedge elements into the recesses 220 of the non-interlock blocking elements, whereby any or all of the drawers 231, 232 and 233 can be opened even though drawer 234 is already open. The uppermost and lowermost blocking elements of furniture unit 230 are shown as conventional interlock blocking elements 6 and the remaining blocking elements disposed between convention blocking elements 6 are shown as non-interlock blocking elements 200. However, it should be understood that only the second, third, fourth and seventh blocking elements from the top need be non-interlock blocking elements in order to allow the drawers of furniture unit 230 to be all open at the same time. The remaining blocking elements can be either non-interlock blocking elements 200 or conventional interlock blocking elements 6.

Figure 22:
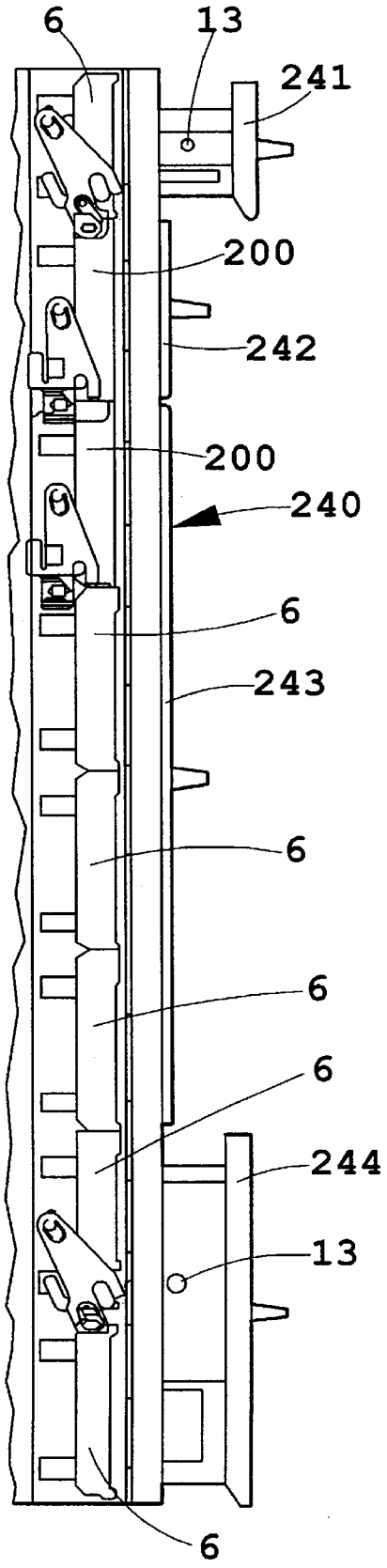
FIG. 22 is a partially schematic, side elevational view of a vertical file including a plurality of non-interlock blocking elements and a plurality of interlock blocking elements disposed in a vertical guide to provide a partially interlocking furniture unit in which at least one of the drawers cannot be opened if any other interlocked drawer is open, while at least one other interlocked drawer can be opened irrespective of whether another drawer or drawers are open.

As illustrated in FIG. 22, the non-interlock blocking elements 200 can be used in combination with interlock blocking elements 6 to provide a furniture unit 240 having a plurality of drawers 241–244, in which at least one of the drawers cannot be opened if any other interlocked drawer is open, and at least one other non-interlocked drawer which can be opened irrespective of whether other drawers are open, thus providing a partially interlocked system. For example, in FIG. 22, only the second and third blocking elements from the top are non-interlock blocking elements 200. The remaining blocking elements are standard interlock blocking elements 6. This particular arrangement allows drawers 241 and 242 to be open irrespective of whether drawer 243 or drawer 244 is already open. However, the arrangement prevents drawers 243 and 244 from being open at the same time.

A conventional interlocking furniture unit having drawers which can only be opened one at a time, can be converted to a non-interlocking furniture unit, or to a partially interlocking furniture unit by removing selected standard interlock blocking elements 6 and replacing them with the non-interlock blocking elements 200. The procedure generally involves removing the pedestal from any associated worksurface, removing the actuators 8, dumping or otherwise removing the blocking elements 6, and replacing the removed blocking elements with non-interlock blocking elements 200 to provide a non-interlocking furniture unit, or replacing the removed blocking elements with a combination of non-interlock blocking elements 200 and standard interlock blocking element 6 to provide a partially interlocking furniture unit.

It will be apparent to those skilled in the art that various modifications to the preferred embodiment of the invention as described herein can be made without departing from the spirit or scope of the invention as defined by the appended claims.

What is claimed is:

1. A furniture unit comprising:

a least an upper drawer and an adjacent lower drawer, each drawer mounted to slide between an open position and a closed position;

a vertical guide;

a plurality of blocking elements disposed in a vertical stack and slidably mounted in the guide for translation in the guide;

first and second wedge elements associated with the upper and lower drawers respectively, the first or second wedge element horizontally reciprocating into the stack of blocking elements when the associated drawer slides to the open position to cause blocking elements disposed at an elevation above the reciprocating wedge element to be shifted upwardly provided that blocking elements above the reciprocating wedge element have not already been shifted upwardly by another wedge element reciprocated into the stack of blocking elements, the first or second wedge element horizontally reciprocating completely out of the stack of blocking elements when the associated drawer slides to the closed position to allow blocking elements disposed at an elevation above the reciprocating wedge element to shift downwardly provided that any blocking elements above the reciprocating wedge element are not retained in an upwardly shifted position by another wedge element;

the first wedge element associated with the upper drawer being disposed along side of and in horizontal alignment with a lower portion of a first of the stacked blocking elements when the lower drawer is in the closed position, and the first wedge element associated with the upper drawer being disposed along side of and in horizontal alignment with an upper portion of a second of the blocking elements disposed vertically adjacent to and below the first of the blocking elements when the lower drawer is in the open position;

a locking mechanism including a member which is movable into a locking space defined above a top blocking element in the stack to prevent any of the blocking elements from being separated from one another a distance sufficient to permit a wedge element to be inserted between vertically adjacent blocking elements, said locking mechanism positively locking the drawers in the closed position; and the second of the blocking elements including a recess which allows unobstructed reciprocation of the wedge element associated with the upper drawer, whereby the upper drawer can be opened when the lower drawer is open.

2. A furniture unit comprising:

an upper drawer, and a plurality of vertically spaced apart lower drawers, each lower drawer being vertically disposed below the upper drawer, each drawer mounted to slide between an open position and a closed position;

a vertical guide;

a plurality of blocking elements disposed in a vertical stack and slidably mounted in the guide for translation in the guide; and a wedge element associated with each of the drawers, each wedge element being horizontally reciprocating into the stack of blocking elements when the associated drawer slides to the open position to cause blocking elements disposed at an elevation above the reciprocating wedge element reciprocated into the stack of blocking elements to shift upwardly provided that the blocking elements above the reciprocating wedge element have not already been shifted upwardly by another wedge element reciprocated into the stack of blocking elements, the wedge elements horizontally reciprocating completely out of the stack of blocking elements when the associated drawer slides to the closed position to allow blocking elements disposed at an elevation above the reciprocating wedge element to be shifted downwardly provided that any blocking elements above the reciprocating wedge element are not retained in an upwardly shifted position by another wedge element;

each wedge element being disposed along side of and in horizontal alignment with a lower portion of one of the stacked blocking elements when the drawers are in the closed position, and each wedge element being disposed along side of and in horizontal alignment with an upper portion of another blocking element when at least one of the lower wedge elements is reciprocated into the stack of blocking elements;

at least a first blocking element including a recess which is disposed along side of and in horizontal alignment with a first wedge element when at least one of the lower wedge elements is reciprocated into the stack of blocking elements, the recess allowing unobstructed reciprocation of the first wedge element when the first wedge element is in horizontal alignment with the upper portion of the first blocking element;

at least a second blocking element including an upper portion which is disposed along side of and in horizontal alignment with a second wedge element when at least one of the lower wedge elements is reciprocated into the stack of blocking elements, the upper portion of the second blocking element being configured to obstruct reciprocation of the second wedge element when the second wedge element is in horizontal alignment with the upper portion of the blocking element, thereby preventing the drawer associated with the second blocking element from sliding to the open position when any lower drawer is open and allowing the drawer associated with the first blocking element sliding to the open position when any lower drawer is open.

3. A furniture unit having a plurality of vertically arranged drawers comprising:

a drawer interlock mechanism preventing a first of the vertically arranged drawers from opening when a second of the vertically arranged drawers is open and allowing a third of the vertically arranged drawers to be opened regardless of whether any other of the vertically arranged drawers is open; and a locking mechanism which cooperates with the drawer interlock mechanism to lock all of the vertically arranged drawers closed.

* * * * *

UNITED STATES PATENT AND TRADEMARK OFFICE

CERTIFICATE OF CORRECTION

PATENT NO. : 5,931,548
DATED : August 3, 1999
INVENTOR : Daniel Ralph Bischoff

It is certified that error appears in the above-identified patent and that said Letters Patent is hereby corrected as shown below:

Title page, Item [73]

Assignee;

"SteelCase Inc. should be --Steelcase Inc.--.

Column 1, line 46;

"simple" should be --simply--.

Column 4, line 64;

"IX-IX" should be -- 9-9 --

Column 5, line 38;

"DETAIL" should be --DETAILED--.

Column 5, line 62;

"give" should be --given--.

Column 6, line 9;

"inbetween" should be -- in between--.

Column 6, line 43;

"pins 13-5" should be --pins 14-15--

UNITED STATES PATENT AND TRADEMARK OFFICE

CERTIFICATE OF CORRECTION

PATENT NO. : 5,931,548
DATED : August 3, 1999
INVENTOR(S) : Daniel Ralph Bischoff It is certified that error appears in the above-identified patent and that said Letters Patent is hereby corrected as shown below:

Column 6, line 59;
"actuators pin 13-15" should be --actuator pins 13-15--.

Column 10, line 9;
"from is" should be --from its--.

Column 10, line 17;
"to is" should be --to its--.

Column 10, line 43;
"U-shape" should be --U-shaped--.

Column 10, line 54;
"distant" should be --distance--.

Column 11, line 62;
"elements 200 has" should be --elements 200 have--.

UNITED STATES PATENT AND TRADEMARK OFFICE

CERTIFICATE OF CORRECTION

PATENT NO. : 5,931,548

DATED : August 3,1999

INVENTOR(S) : Daniel Ralph Bischoff

It is certified that error appears in the above-identified patent and that said Letters Patent is hereby corrected as shown below:

Column 12, line 6;
"blocking elements 2006" should be --blocking elements 6--.

Column 12, line 7;
After "blocking element" (2nd occurrence), insert --200--.

Column 12, line 59;
"convention" should be --conventional--.

Signed and Sealed this

Sixth Day of June, 2000

*Attest:*

Q. TODD DICKINSON

*Attesting Officer*

*Director of Patents and Trademarks*